US006279366B1

(12) United States Patent
Sakaguchi

(10) Patent No.: US 6,279,366 B1
(45) Date of Patent: Aug. 28, 2001

(54) ITEM WITH EXTERNAL TEETH AND METHOD OF FORMING THE SAME

(75) Inventor: Teppei Sakaguchi, Osaka (JP)

(73) Assignee: Samtech Corporation, Osaka (JP)

( * ) Notice: Subject to any disclaimer, the term of this patent is extended or adjusted under 35 U.S.C. 154(b) by 0 days.

(21) Appl. No.: 09/615,841

(22) Filed: Jul. 13, 2000

(30) Foreign Application Priority Data

Jan. 12, 2000 (JP) ..... 12-003627

(51) Int. Cl.[7] ..... B21B 27/00

(52) U.S. Cl. ..... 72/102; 72/84; 72/107; 72/110; 72/121; 29/893.32

(58) Field of Search ..... 72/84, 95, 98, 72/100, 102, 107, 110, 121; 29/893.32, 893.34

(56) References Cited

U.S. PATENT DOCUMENTS

| | | | | |
|---|---|---|---|---|
| 1,568,648 | * | 1/1926 | White | 72/85 |
| 5,301,528 | * | 4/1994 | Hofmann et al. | 72/96 |
| 5,544,548 | * | 8/1996 | Iihara et al. | 72/343 |
| 5,953,947 | * | 9/1999 | Klein | 72/213 |
| 6,101,717 | * | 8/2000 | Shohara et al. | 72/110 |

FOREIGN PATENT DOCUMENTS

| | | |
|---|---|---|
| 196 13 457 C1 | 4/1997 | (DE) . |
| 50-108146 | 8/1975 | (JP) . |
| 2997458 | 10/1999 | (JP) . |
| 2000-130561 | 5/2000 | (JP) . |

* cited by examiner

*Primary Examiner*—Ed Tolan
(74) *Attorney, Agent, or Firm*—Eric J. Robinson; Nixon Peabody LLP

(57) ABSTRACT

Using a form roller in which a plurality of gear-like tooth generating sections are arranged along the rotation axis of the form roller in the outer periphery thereof to increase tooth heights of the tooth generating sections in a stepwise manner along the rotation axis, a plurality of teeth are generated stepwise in the outer periphery of a metallic material by pressing the plurality of gear-like tooth generating sections of the form roller in increasing order of tooth height against the outer periphery of the rotating metallic material while transmitting the rotation force of the metallic material to the form roller to roll the form roller along the outer periphery of the metallic material, and are finished to size by cold pressing. In this manner, external teeth can be generated in the outer periphery of the metallic material with high efficiency and accuracy and without decreasing strength.

5 Claims, 15 Drawing Sheets

Y1
Y2
1
2
3
B
t1
12
15
15a
16
16a
17
17a
18
18a

Y1
Y2
12
15
16
17
18
15a
16a
17a
18a
1
2
3
B
t3

ITEM WITH EXTERNAL TEETH AND METHOD OF FORMING THE SAME

BACKGROUND OF THE INVENTION

This invention relates to an item with external teeth, such as a gear, and a method of forming the item.

Conventionally, formation of an item with external teeth such as a gear is implemented by a method of forming teeth by cutting a workpiece such as a forged blank into shape or a method of forming teeth by forging a workpiece into shape. In the former method of teeth formation by cutting, however, the working speed is too low and a grinding process is required for improving the surface roughness of the teeth after the cutting process. Accordingly, the former method involves much time taken for teeth formation. On the other hand, the latter method of teeth formation by forging causes problems of enormous expense in plant and equipment, difficulty in fabricating a die and deterioration in work environment due to the use of lubricant, for example, in a Bonderite process, for the purpose of increase in die life and formability.

Meanwhile, as disclosed in the specification and drawings of German Patent Publication No. 19613457, there is a method of generating external teeth in the outer periphery of a workpiece with the use of an external gear tooth generating device including a form roller having an outer periphery formed with four gear-like tooth generating sections of different tooth heights changed in four steps along the rotation axis of the roller to increase the outer diameter of the roller in a stepwise manner. In this method, the tooth generating sections are pressed in increasing order of tooth height against the outer periphery of a rotating workpiece so that the rotation force of the workpiece is transmitted to the form roller. The form roller thereby step wise generates a plurality of teeth of given shape in the outer periphery of the workpiece while rolling therealong. According to this method of external teeth generation, since the teeth are generated by plastic deformation of a workpiece, the drawbacks due to cutting as described above cannot be caused. In addition, since the form roller can be made relatively cheap and easily, the problems due to forging as described above never occur. It is to be noted that the reason why the generation of teeth of given shape (tooth grooves of given depth) is made stepwise in four divided generating steps is that teeth generation in a single step would create extended or recessed tooth portion thereby not providing a complete tooth profile.

Furthermore, in the above method of external teeth generation, since both the workpiece and the form roller are rolled one along another to generate the external teeth, it is difficult that the tooth generating sections of the form roller are pressed evenly against both sides of each tooth which serve as mating surfaces of each of fully generated teeth. As a result, the mating surfaces of each of the teeth easily produce a variation in forming accuracy. This is a serious problem for gears requiring high accuracy. In order to eliminate such a variation, the teeth must be finished by cutting. In this case, however, the flow line of metal texture having been formed along the tooth profile during the tooth generating process is broken, resulting in decreased strength.

SUMMARY OF THE INVENTION

In view of the foregoing problems, an object of the present invention is to generate external teeth in the outer periphery of a workpiece with high efficiency and accuracy and without decreasing strength.

To attain the above object, the present invention is characterized by generating external teeth in the outer periphery of a workpiece (metallic material) by using cold pressing in addition to form rolling in which the workpiece and a form roller are rolled one along another as disclosed in the above Publication.

More specifically, the present invention is directed to an item with external teeth and a method of forming the item. The invention as claimed in Claims 1 through 5 relates to the item with external teeth, and the invention as claimed in Claims 6 through 10 relates to the method of forming the item. In these Claims, the following solutions are taken.

A solution taken in the invention of Claim 1 is directed to an externally-toothed item having an outer periphery formed with a plurality of external teeth, and is characterized in that the external teeth are generated stepwise in the outer periphery of a metallic material by pressing a plurality of gear-like tooth generating sections of a form roller, the plurality of gear-like tooth generating sections being arranged along the rotation axis of the form roller in the outer periphery of the form roller to increase tooth heights of the tooth generating sections in a stepwise manner along the rotation axis, against the outer periphery of the rotating metallic material in increasing order of tooth height of the tooth generating sections while transmitting the rotation force of the metallic material to the form roller to roll the form roller along the outer periphery of the metallic material, and are finished to size by cold pressing.

With the above construction, even if the mating surfaces of each of the teeth produce a variation in forming accuracy by form rolling, such a variation due to form rolling is leveled in the succeeding cold pressing step so that the teeth can be finished with high accuracy. In addition, since such leveling is made by cold pressing, the flow line of metal texture can be prevented from being broken thereby ensuring strength.

A solution taken in the invention of Claim 2 is characterized in that in the externally-toothed item of claim 1, the form roller is constructed so that the tooth generating sections have equal distances between the rotation axis of the form roller and respective tooth tip faces of the tooth generating sections and such different distances between the rotation axis and respective bottom lands of the tooth generating sections as decreased in plural steps along the rotation axis to increase tooth heights of the tooth generating sections in a stepwise manner along the rotation axis.

With this construction, an example of the form roller is embodied.

A solution taken in the invention of Claim 3 is characterized in that in the externally-tooth item of claim 2, the form roller is constructed so that in generating the teeth, the tooth generating sections are consecutively pressed in increasing order of the tooth height against the metallic material without stopping the rotation of the metallic material.

With this construction, the tooth generating sections have equal distances between the rotation axis of the form roller and their respective tooth tip faces, i.e., equal outer diameters, and the next-step tooth generating section does not protrude beyond the preceding-step one. Therefore, such a phenomenon that the metallic material may be held by engagement on a shoulder of the next-step tooth generating section protruding beyond the preceding-step one against relative movement from the preceding-step tooth generating section to the next-step one never occurs. Accordingly, while only a slight backward movement of the form roller is necessary for the purpose of smooth movement of the next-step tooth generating section onto the metallic material in making the next-step tooth generating section ready for working the metallic material, the form roller can be moved along its rotation axis as the metallic material is rotated without stopping its rotation. As a result, the time taken to generate teeth can be reduced as compared with the case of repeating rotation and stop of the metallic material, thereby increasing the efficiency of teeth generation.

A solution taken in the invention of Claim 4 is characterized in that in the externally-toothed item of claim 1, the form roller is constructed so that the tooth generating sections have equal distances between the rotation axis of the form roller and respective bottom lands of the tooth generating sections and such different distances between the rotation axis and respective tooth tip faces of the tooth generating sections as increased in plural steps along the rotation axis to increase tooth heights of the tooth generating sections in a stepwise manner along the rotation axis.

With this construction, another example of the form roller is embodied.

A solution taken in the invention of Claim 5 is characterized in that in the externally-toothed item of Claim 1, the item is a spur gear, a helical gear, a sprocket wheel or a splined shaft.

With this construction, the item is specified.

A solution taken in the invention of Claim 6 is characterized by including the steps of: preparing an external gear tooth generating device including a setting stage rotatable around its rotation axis to rotate a workpiece set thereon and a form roller, disposed beside the setting stage, rotatable around its rotation axis parallel with the rotation axis of the setting stage and movable in a direction orthogonal to the rotation axes, the form roller having a plurality of gear-like tooth generating sections arranged along the rotation axis in the outer periphery of the form roller to increase tooth heights of the tooth generating sections in a stepwise manner along different distances between the rotation axis and respective bottom lands of the tooth generating sections as decreased in plural steps along the rotation axis to increase tooth heights of the tooth generating sections in a stepwise manner along the rotation axis.

With this method, as described in the solution of Claim 2, an example of the form roller is embodied.

A solution taken in the invention of Claim 8 is characterized in that in the method of Claim 7, the form roller is constructed so that in generating the teeth, the tooth generating sections are consecutively pressed in increasing order of the tooth height against the workpiece without stopping the rotation of the workpiece.

With this method, as described in the solution of Claim 3, the tooth generating sections have equal distances between the rotation axis of the form roller and their respective tooth tip faces, i.e., equal outer diameters, and the next-step tooth generating section does not protrude beyond the preceding-step one. Therefore, such a phenomenon that the workpiece may be held by engagement on a shoulder of the next-step tooth generating section protruding beyond the preceding-step one against relative movement from the preceding-step tooth generating section to the next-step one never occurs. Accordingly, while only a slight backward movement of the form roller is necessary for the purpose of smooth movement of the next-step tooth generating section onto the workpiece in making the next-step tooth generating section ready for working the workpiece, the the rotation axis; rotating the workpiece set on the setting stage of the external gear tooth generating device by rotational movement of the setting stage around the rotation axis thereof, moving the form roller in the direction orthogonal to its rotation axis so as to come close to the workpiece to press the tooth generating sections in increasing order of the tooth height against the outer periphery of the workpiece, and stepwise generating a plurality of teeth of given shape in the outer periphery of the workpiece with the tooth generating sections while transmitting the rotation force of the workpiece to the form roller to roll the form roller along the outer periphery of the workpiece, thereby obtaining an externally-toothed item having an outer periphery formed with a plurality of external teeth; and then finishing the teeth to size by cold pressing.

With this method, as described in the solution of Claim 1, even if the mating surfaces of each of the teeth produce a variation in forming accuracy by form rolling, such a variation due to form rolling is leveled in the succeeding cold pressing step so that the teeth can be finished with high accuracy. In addition, since such leveling is made by cold pressing, the flow line of metal texture can be prevented from being broken thereby ensuring strength.

A solution taken in the invention of Claim 7 is characterized in that in the method of Claim 6, the form roller is constructed so that the tooth generating sections have equal distances between the rotation axis of the form roller and respective tooth tip faces of the tooth generating sections and such form roller can be moved along its rotation axis as the workpiece is rotated without stopping its rotation. As a result, the time taken to generate teeth can be reduced as compared with the case of repeating rotation and stop of the workpiece, thereby increasing the efficiency of teeth generation.

A solution taken in the invention of Claim 9 is characterized in that in the method of Claim 6, the form roller is constructed so that the tooth generating sections have equal distances between the rotation axis of the form roller and respective bottom lands of the tooth generating sections and such different distances between the rotation axis and respective tooth tip faces of the tooth generating sections as increased in plural steps along the rotation axis to increase tooth heights of the tooth generating sections in a stepwise manner along the rotation axis.

With this method, as described in the solution of Claim 4, another example of the form roller is embodied.

A solution taken in the invention of Claim 10 is characterized in that in the method of Claim 6, the workpiece is a metallic material for generating a spur gear, a helical gear, a sprocket wheel or a splined shaft.

With this method, as described in the solution of Claim 5, the item is specified.

BRIEF DESCRIPTION OF THE DRAWINGS

FIG. 3(*b*) is a view showing a step of the process in which the first-step tooth generating section generates first-step teeth in the workpiece in Embodiment 1.

FIG. 3(*c*) is across-sectional view showing the workpiece in which the first-step teeth have been generated in Embodiment 1.

FIG. 4(*b*) is a view showing a step of the process in which the second-step tooth generating section generates second-step teeth in the workpiece in Embodiment 1.

FIG. 4(*c*) is a cross-sectional view showing the workpiece in which the second-step teeth have been generated in Embodiment 1.

FIG. 5(*b*) is a view showing a step of the process in which the third-step tooth generating section generates third-step teeth in the workpiece in Embodiment 1.

FIG. 5(*c*) is across-sectional view showing the workpiece in which the third-step teeth have been generated in Embodiment 1.

FIG. 6(*b*) is a view showing a step of the process in which the fourth-step tooth generating section generates fourth-step teeth in the workpiece in Embodiment 1.

FIG. 6(*c*) is a cross-sectional view showing a final product in which the fourth-step teeth have been generated in Embodiment 1.

FIG. 7(*b*) is a partly perspective view of a form roller used in Embodiment 1.

FIG. 7(*c*) is a corresponding view of FIG. 7(*a*), showing a modification of Embodiment 1.

FIG. 8(*b*) is a perspective view of a final product after teeth have been fully generated therein.

FIG. 11(*b*) is a view showing a step of the process in which the first-step tooth generating section generates first-step teeth in the workpiece in Embodiment 2.

FIG. 11(*c*) is a cross-sectional view showing the workpiece in which the first-step teeth have been generated in Embodiment 2.

FIG. 12(*b*) is a view showing a step of the process in which the second-step tooth generating section generates second-step teeth in the workpiece in Embodiment 2.

FIG. 12(*c*) is a cross-sectional view showing the workpiece in which the second-step teeth have been generated in Embodiment 2.

FIG. 13(*b*) is a view showing a step of the process in which the third-step tooth generating section generates third-step teeth in the workpiece in Embodiment 2.

FIG. 13(*c*) is a cross-sectional view showing the workpiece in which the third-step teeth have been generated in Embodiment 2.

FIG. 14(*b*) is a view showing a step of the process in which the fourth-step tooth generating section generates fourth-step teeth in the workpiece in Embodiment 2.

FIG. 14(*c*) is a cross-sectional view showing a final product in which the fourth-step teeth have been generated in Embodiment 2.

FIG. 15(*b*) is a partly perspective view of a form roller used in Embodiment 2.

DESCRIPTION OF THE PREFERRED EMBODIMENTS

Hereinafter, embodiments of the present invention will be described with reference to the accompanying drawings.

(Embodiment 1)

Figure 1:
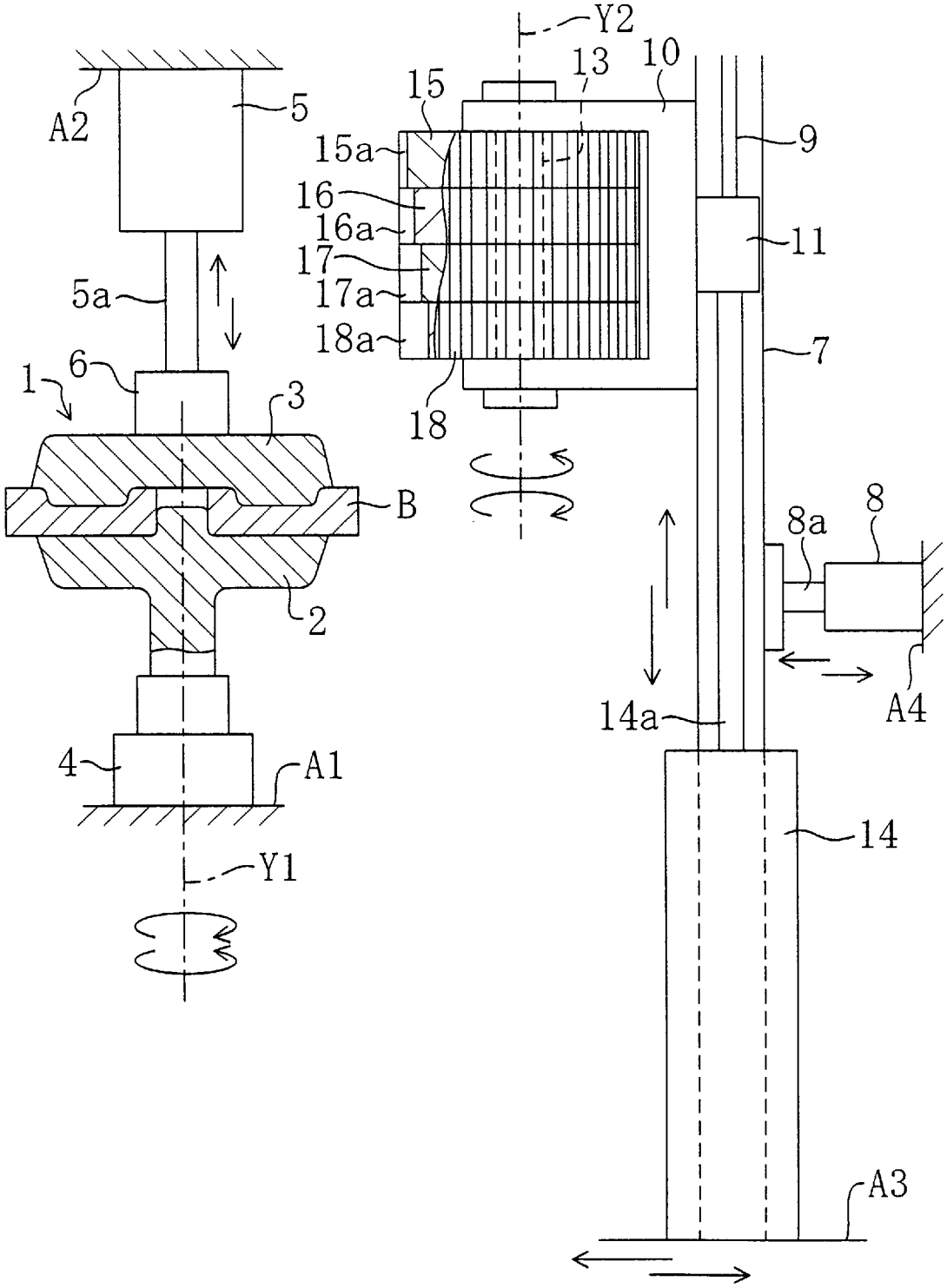
FIG. 1 is a view schematically showing a general structure of an external gear tooth generating device according to Embodiment 1 of the invention.

FIG. 1 schematically shows an external gear tooth generating device used to form an externally-toothed item in Embodiment 1 of the present invention. First, the construction of the external gear tooth generating device will be described.

As shown in FIG. 1, a setting stage 1 consists of a receiving jig 2 and a holding jig 3. The receiving jig 2 of the setting stage 1 is drivingly connected to an output shaft of a drive motor 4 mounted on a fixed part A1 located on the base side of the device, while the holding jig 3 is connected through a bearing 6 to an end of a piston rod 5*a* extending downward from a first fluid-pressure operated cylinder 5 disposed at an upper fixed part A2 located above the device base side fixed part A1. The device is arranged to cause a workpiece B of metallic material to be put on the receiving jig 2, move the holding jig 3 downward by an extending action of the piston rod 5*a* of the first fluid-pressure operated cylinder 5 until the workpiece B has been held against movement thereby setting the workpiece B on the setting stage 1, and rotate the setting stage 1 in this position in forward and reverse directions around a perpendicularly extending rotation axis Y1 by forward and reverse driving of the drive motor 4 to rotate the workpiece B in forward and reverse directions. The present embodiment illustrates the case where the workpiece B is a blank (see FIG. 8(*a*)) for a spur gear G (see FIG. 8(*b*)) having an outer periphery with a plurality of teeth T.

Beside the setting stage 1, a support post 7 is provided at a movable part A3 located on the base side of the device. The support post 7 is connected to an end of a piston rod 8*a* extending horizontally from a second fluid-pressure operated cylinder 8 disposed at a fixed part A4 located beside the device. A vertically extending guide rail 9 is attached to the support post 7. A U-shaped support member 10 is connected at a proximal end thereof to the guide rail 9 for upward and downward movement through a slider 11. Between bifurcated distal ends of the support member 10, a form roller 12 is carried on a vertically extending rotation shaft 13 so as to freely rotate around a rotation axis Y2 parallel with the rotation axis Y1 of the setting stage 1, and is placed beside the setting stage 1. The form roller 12 is arranged to move in a direction orthogonal to the rotational axes Y1 and Y2 by an extending or retracting action of the piston rod 8*a* of the second fluid-pressure operated cylinder 8. More specifically, by an extending action of the piston rod 8*a* of the second fluid-pressure operated cylinder 8, the form roller 12 comes close to the setting stage 1 together with the device base side movable part A3 and is pressed against the workpiece B, thereby rolling along the outer periphery of the work piece B by a rotation force transmitted from the workpiece B. Furthermore, the form roller 12 is connected through the slider 11 to an end of a piston rod 14*a* extending upward from a third fluid-pressure operated cylinder 14 disposed at the device base side movable part A3, so as to move in a direction of the rotational axes Y1 and Y2 along the guide rail 9 by an extending or retracting action of the piston rod 14*a* of the third fluid-pressure operated cylinder 14.

Figure 7C:
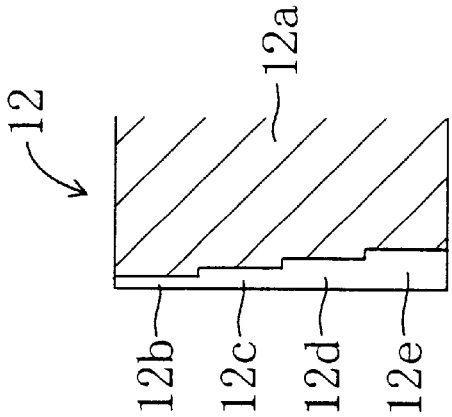
FIG. 7(*a*) is a cross-sectional view taken along the line I—I of FIG. 7(*b*).
Figure 7B:
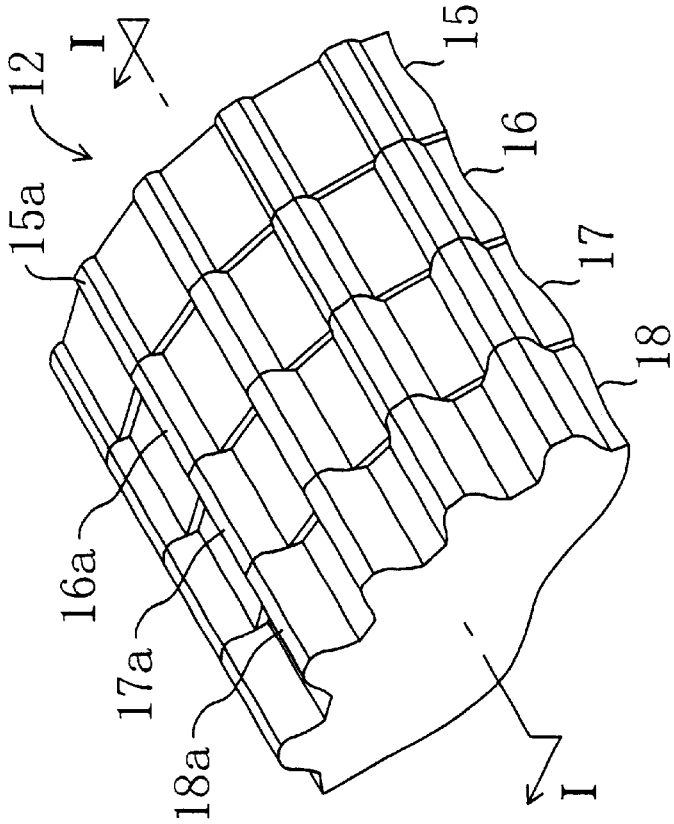
Figure 7A:
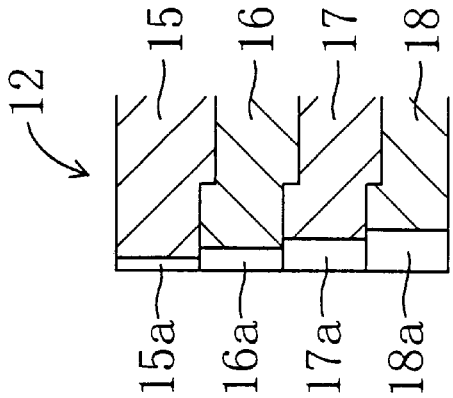

As shown in an enlarged and detailed manner in FIGS. 7(*a*) and 7(*b*), the outer periphery of the form roller 12 is formed with four tooth generating sections 15*a*, 16*a*, 17*a* and 18*a* which incrementally change their tooth heights (whole depths) in four steps in a downward direction along the rotation axis Y2. The form roller 12 is constructed by assembling four roller components 15, 16, 17 and 18 segmented for every tooth generating section 15*a*, 16*a*, 17*a* and 18*a* into one piece. Alternatively, the form roller 12 maybe constructed of a unitary member as shown in FIG. 7(*c*), instead of segmental type one mentioned above.

The form roller 12 is constructed so that the tooth generating sections 15*a*, 16*a*, 17*a* and 18*a* have equal distances between the rotation axis Y2 to their respective tooth tip faces and such different distances between the rotation axis Y2 and their respective bottom lands as decreased in four steps downwardly in the direction of the rotation axis Y2 to increase tooth heights of the tooth generating sections 15*a*, 16*a*, 17*a* and 18*a* in a stepwise manner downwardly in the direction of the rotation axis Y2, and in generating the teeth, the tooth generating sections 15*a*, 16*a*, 17*a* and 18*a* are consecutively pressed in increasing order of the tooth height against the workpiece B without stopping the rotation of the workpiece B. Also for the form roller 12 of unitary construction shown in FIG. 7(*c*), the outer periphery of a roller body 12*a* is formed with four tooth generating sections 12*b*, 12*c*, 12*d* and 12*e* which incrementally change their tooth heights (whole depths) in four steps in a downward direction along the rotation axis.

Figure 8A:
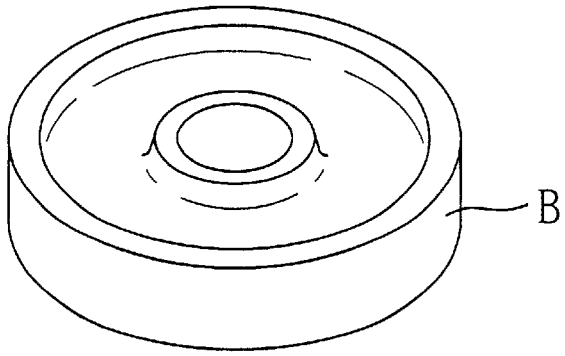
FIG. 8(*a*) is a perspective view of a workpiece before teeth are generated therein.
Figure 8B:
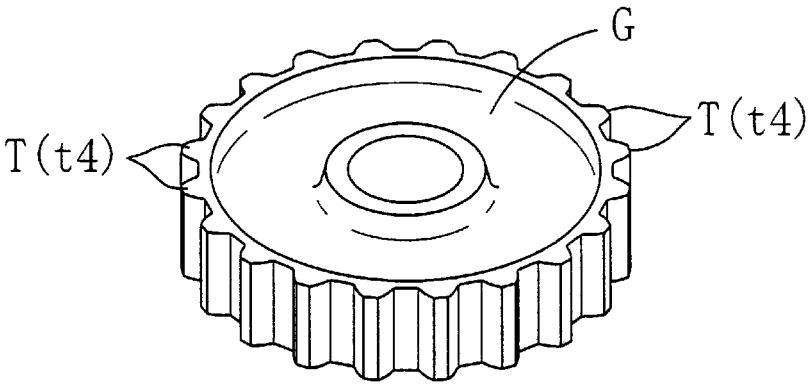

Under the above construction, when the workpiece B is set on the setting stage 1 and the setting stage 1 is then rotated around the rotation axis Y1 by driving the drive motor 4, the workpiece B is rotated. In this condition, the form roller 12 is moved downward from above by a retracting action of the piston rod 14*a* of the third fluid-pressure operated cylinder 14 so that the tooth generating section 15*a* of smallest tooth height is ready for working the outer periphery of the workpiece B. Subsequently, the form roller 12 is moved in the direction orthogonal to the rotation axis Y2 by an extending action of the piston rod 8*a* of the second fluid-pressure operated cylinder 8 so as to come close to the workpiece B together with the device base side movable part A3, so that the tooth generating section 15*a* is pressed against the outer periphery of the workpiece B. The rotation force of the workpiece B is thereby transmitted to the form roller 12. As a result, the form roller 12 generates, with the tooth generating section 15*a*, a plurality of teeth of smallest tooth height conforming to the profile of the tooth generating section 15*a* in the outer periphery of the workpiece B while rolling therealong. Such operations as described so far are repeated for the other tooth generating sections in increasing order of the tooth height so that respective teeth different in tooth heights (see FIGS. 3(*c*) through 6(*c*)) are generated stepwise in the outer periphery of the workpiece B with the tooth generating sections 15*a*, 16*a*, 17*a* and 18*a*. As a result, a final product is fabricated which is a spur gear G with teeth T of given shape as shown in FIG. 8(*b*).

Next, description will be made about respective Steps 1 through 6 in a process of fabricating a spur gear G by generating teeth T in the outer periphery of a workpiece B with the use of the external gear tooth generating device having the above construction with reference to FIGS. 2 through 6.

Step 1

Figure 2:
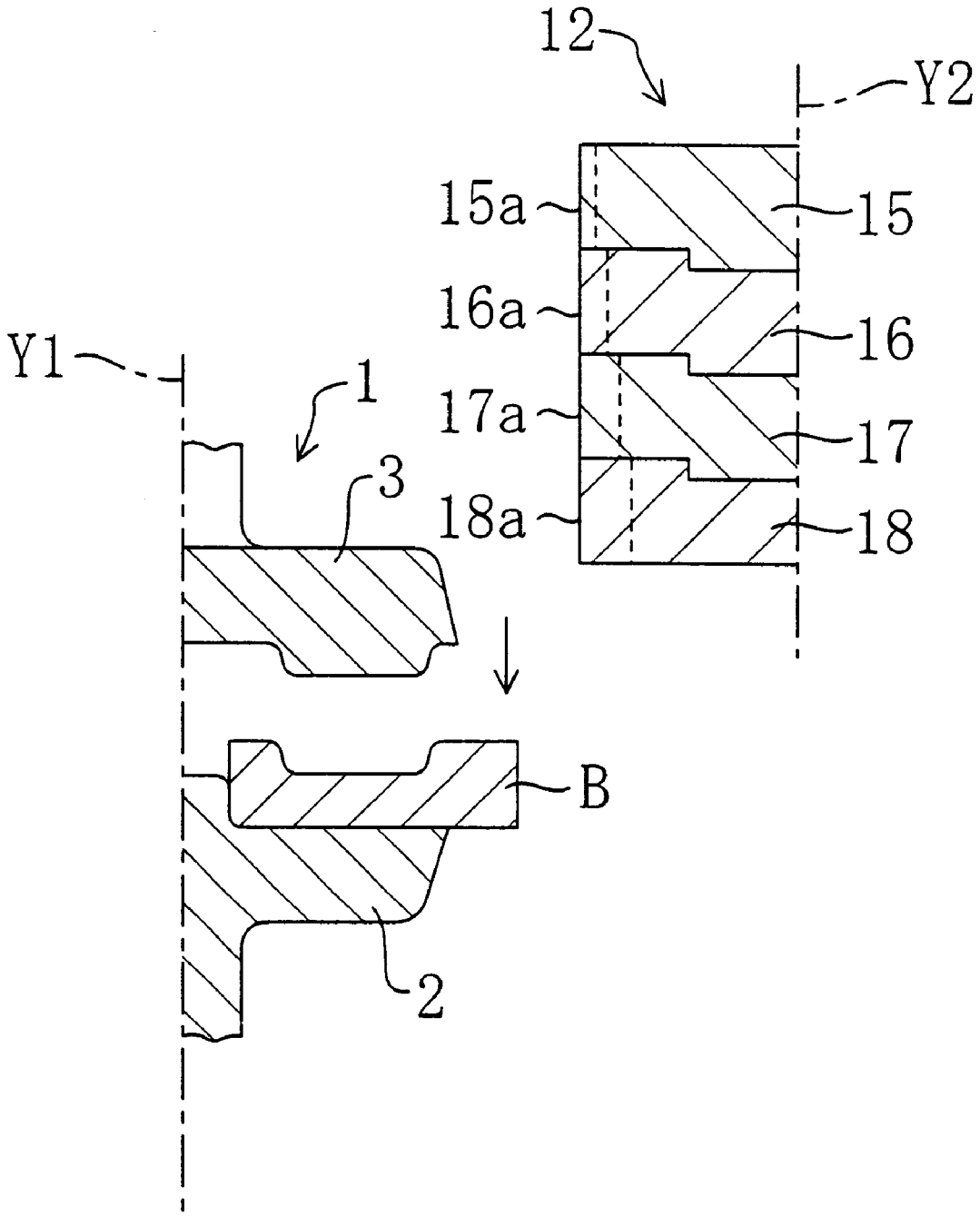
FIG. 2 is a view showing a step of the process in which a workpiece is fixed on a setting stage in Embodiment 1.

FIG. 2 illustrates a condition that a spur gear G as a final product with teeth T finally generated has been just removed from the device after the completion of the preceding tooth generating work, in which the holding jig 3 of the setting stage 1 is positioned above and apart from the receiving jig 2 and the form roller 12 has been moved laterally upward from the holding jig 3. In this condition, the piston rod 5*a* of the first fluid-pressure operated cylinder 5 is extended to move the holding jig 3 downward so that the workpiece B is held by the holding jig 3 and set on the setting stage 1.

Step 2

Figures 3A, 3B, 3C:
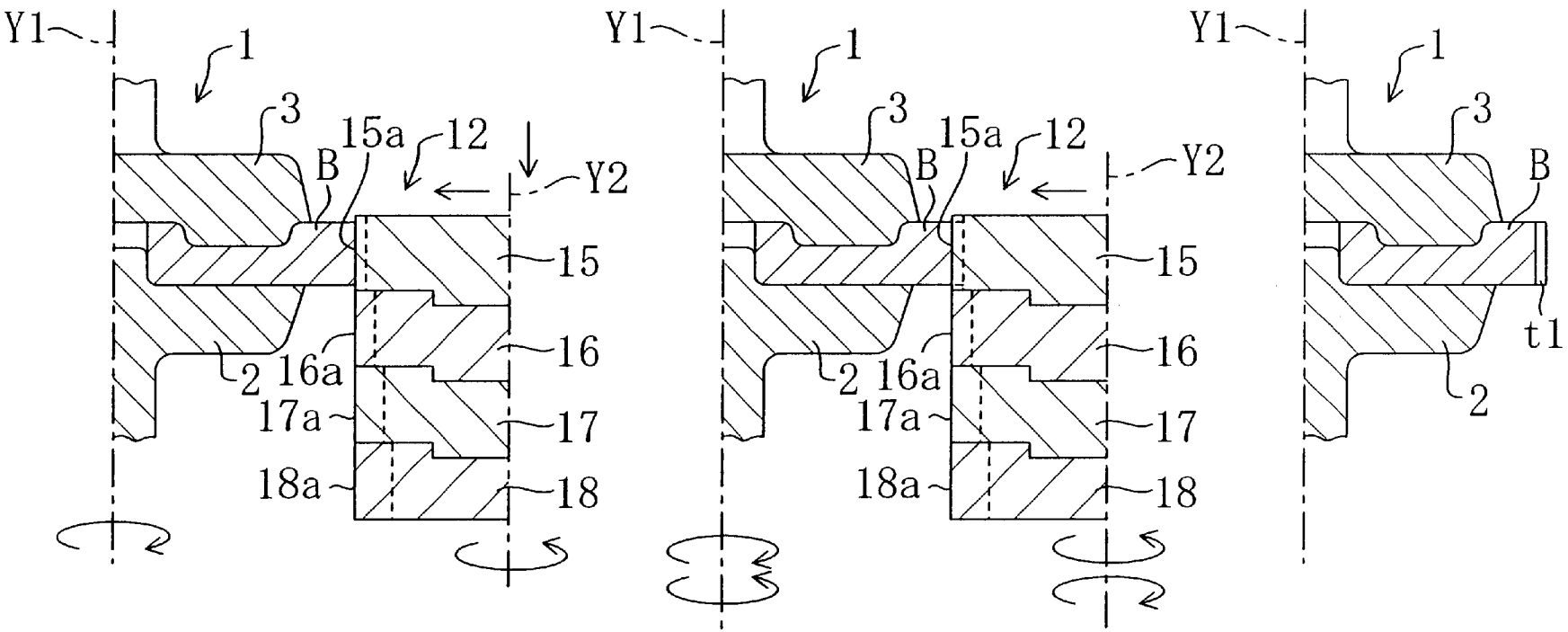
FIG. 3(*a*) is a view showing a step of the process in which a first-step tooth generating section of the form roller is allowed for handling the workpiece in Embodiment 1.

As shown in FIG. 3(*a*), the drive motor 4 is driven into rotation of a single direction to rotate the setting stage 1 and in turn the workpiece B around the rotation axis Y1. In this condition, the piston rod 14*a* of the third fluid-pressure operated cylinder 14 is retracted to move the form roller 12 downward so that the uppermost tooth generating section (hereinafter, referred to as a "first-step tooth generating section") 15*a* of smallest tooth height can be ready for working the outer periphery of the workpiece B. Then, the piston rod 8*a* of the second fluid-pressure operated cylinder 8 is extended to move the form roller 12 closer to the setting stage 1 together with the device base side movable part A3, so that the first-step tooth generating section 15*a* is pressed against the outer periphery of the workpiece B. The rotation force of the workpiece B is thereby transmitted to the form roller 12 so that the form roller 12 generates, with the first-step tooth generating section 15*a*, a plurality of teeth t1 conforming to the profile of-the first-step tooth generating section 15*a* in the outer periphery of the workpiece B while rolling therealong in a direction opposite to the workpiece B (see FIGS. 3(*b*) and 3(*c*)). During this period of teeth generation, the drive motor 4 is driven into forward and reverse rotation at specific intervals, thereby increasing forming accuracy on both sides of each of teeth t1 which serve as mating surfaces of each of fully generated teeth.

Step 3

Figures 4A, 4B, 4C:
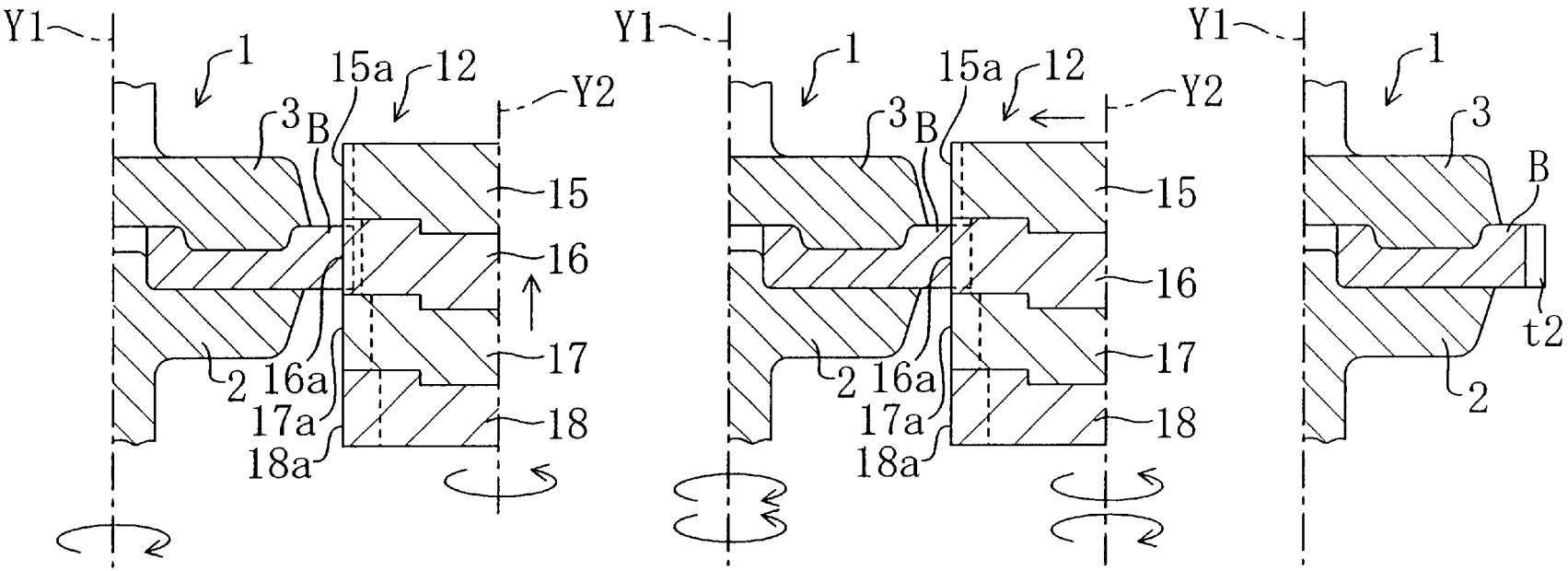
FIG. 4(*a*) is a view showing a step of the process in which a second-step tooth generating section is allowed for handling the workpiece in Embodiment 1.

As shown in FIG. 4(*a*), the piston rod 14*a* of the third fluid-pressure operated cylinder 14 is extended to move the form roller 12 upward so that the second-uppermost tooth generating section (hereinafter, referred to as a "second-step tooth generating section") 16*a* of second-smallest tooth height can be ready for working the outer periphery of the workpiece B. At this point, the piston rod 8*a* of the second fluid-pressure operated cylinder 8 is retracted to slightly stay back the form roller 12 so that the first-step tooth generating section 15*a* is prevented from being rubbed against an end of the tooth t1 of the workpiece B. During the time of retraction of the piston rod 8*a*, the rotation force of the workpiece B is continuously transmitted to the form roller 12 to allow the form roller 12 to roll along the outer periphery of the workpiece B. Thereafter, the piston rod 8*a* of the second fluid-pressure operated cylinder 8 is extended to press the second-step tooth generating section 16*a* against the outer periphery (tooth t1) of the workpiece B. As a result, a plurality of teeth t2 conforming to the profile of the second-step tooth generating section 16*a* are generated in the outer periphery of the workpiece B with the second-step tooth generating section 16*a* (see FIGS. 4(*b*) and 4(*c*)) Also during this period of teeth generation, the drive motor 4 is driven into forward and reverse rotation at specific intervals, thereby increasing forming accuracy on both sides of each of teeth t2 which serve as mating surfaces of each of fully generated teeth.

Step 4

Figures 5A, 5B, 5C:
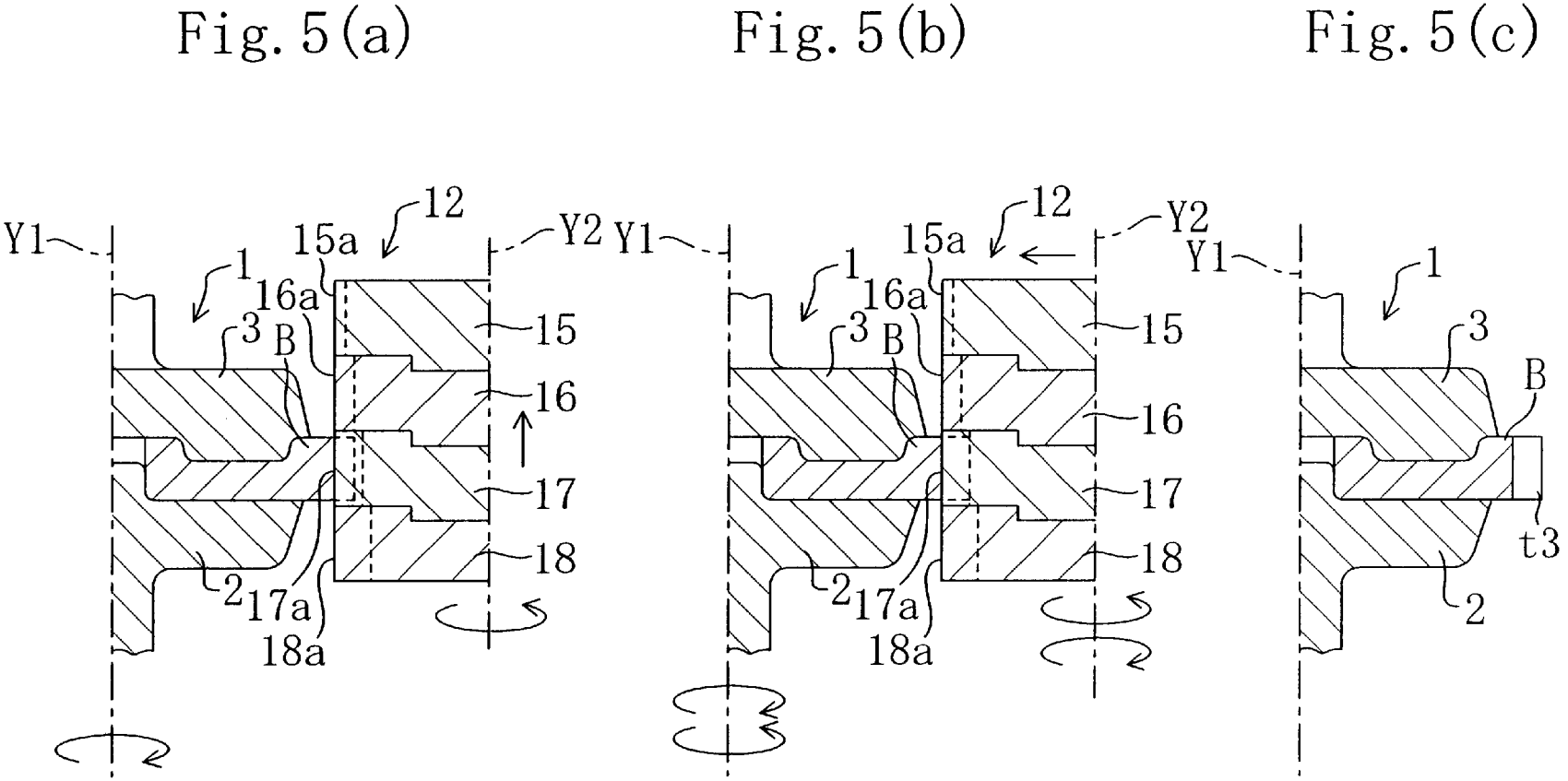
FIG. 5(*a*) is a view showing a step of the process in which a third-step tooth generating section is allowed for handling the workpiece in Embodiment 1.

As shown in FIG. 5(*a*), the piston rod 14*a* of the third fluid-pressure operated cylinder 14 is extended to move the form roller 12 upward so that the third-uppermost tooth generating section (hereinafter, referred to as a "third-step tooth generating section") 17*a* of third-smallest tooth height can be ready for working the outer periphery of the workpiece B. Also at this point, the piston rod 8*a* of the second fluid-pressure operated cylinder 8 is retracted to slightly stay back the form roller 12 so that the second-step tooth generating section 16*a* is prevented from being rubbed against an end of the tooth t2 of the workpiece B. Like Step 3, during the time of retraction of the piston rod 8*a*, the rotation force of the work piece B is continuously transmitted to the form roller 12 to allow the form roller 12 to roll along the outer periphery of the workpiece B. Thereafter, the piston rod 8*a* of the second fluid-pressure operated cylinder 8 is extended to press the third-step tooth generating section 17*a* against the outer periphery (tooth t2) of the workpiece B. As a result, a plurality of teeth t3 conforming to the profile of the third-step tooth generating section 17*a* are generated in the outer periphery of the workpiece B with the third-step tooth generating section 17*a* (see FIGS. 5(*b*) and 5(*c*)). Also during this period of teeth generation, the drive motor 4 is driven into forward and reverse rotation at specific intervals, thereby increasing forming accuracy on both sides of each of teeth t3 which serve as mating surfaces of each of fully generated teeth.

Step 5

Figures 6A, 6B, 6C:
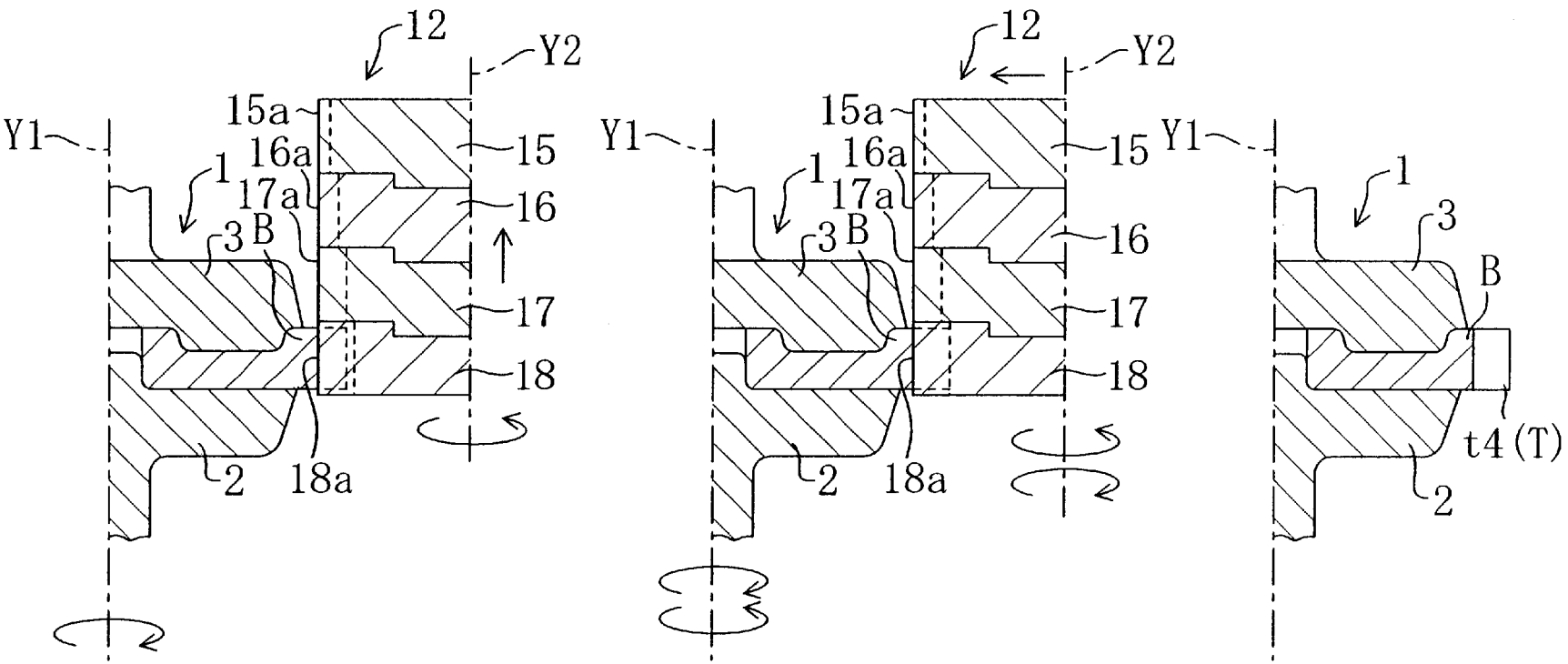
FIG. 6(*a*) is a view showing a step of the process in which a fourth-step tooth generating section is allowed for handling the workpiece in Embodiment 1.

As shown in FIG. 6(*a*), the piston rod 14*a* of the third fluid-pressure operated cylinder 14 is extended to move the form roller 12 upward so that the lowermost tooth generating section (hereinafter, referred to as a "fourth-step tooth generating section") 18*a* of greatest tooth height can be ready for working the outer periphery of the workpiece B. Also at this point, the piston rod 8*a* of the second fluid-pressure operated cylinder 8 is retracted to slightly stay back the form roller 12 so that the third-step tooth generating section 17*a* is prevented from being rubbed against an end of the tooth t3 of the workpiece B. Like Step 3, during the time of retraction of the piston rod 8*a*, the rotation force of the workpiece B is continuously transmitted to the form roller 12 to allow the form roller 12 to roll along the outer periphery of the workpiece B. Thereafter, the piston rod 8*a* of the second fluid-pressure operated cylinder 8 is extended to press the fourth-step tooth generating section 18*a* against the outer periphery (tooth t3) of the workpiece B. As a result, a plurality of teeth t4 (teeth T of a spur gear G as a final product) conforming to the profile of the fourth-step tooth generating section 18*a* are generated in the outer periphery of the workpiece B with the fourth-step tooth generating section 18*a* (see FIGS. 6(*b*), 6(*c*) and 8(*b*)). Also during this period of teeth generation, the drive motor 4 is driven into forward and reverse rotation at specific intervals, thereby increasing forming accuracy on both sides of each of teeth t4 (T) which serve as mating surfaces of each of fully generated teeth. Particularly in the final stage of this step, the workpiece B is rotated in the same direction as that of the spur gear G as a final product in actual use. Accordingly, mating surfaces of teeth T of the spur gear G with which another spur gear G is mated in actual use can be finished with good smoothness and high accuracy.

Step 6

The drive motor 4 is deactivated to stop the rotation of the spur gear G as a final product. The rotation of the form roller 12 is thereby stopped. In this condition, the piston rod 8*a* of the second fluid-pressure operated cylinder 8 is retracted to move the form roller 12 backward. Then, the piston rod 14*a* of the third fluid-pressure operated cylinder 14 is extended to move the form roller 12 upward for a standby for the next working process. And, the piston rod 5*a* of the first fluid-pressure operated cylinder 5 is retracted to move the holding jig 3 upward and the spur gear C as a final product on the receiving jig 2 is recovered.

As described above, the form roller 12 in Embodiment 1, including four tooth generating sections 15*a*, 16*a*, 17*a* and 18*a* from the first-step one of smallest tooth height to the fourth-step one of greatest tooth height, is constructed so that the tooth generating sections 15*a*, 16*a*, 17*a* and 18*a* have equal distances between the rotation axis Y2 and their respective tooth tip faces, i.e., equal outer diameters, and such different distances between the rotation axis Y2 and their respective bottom lands as decreased in four steps to increase the tooth heights of the tooth generating sections 15*a*, 16*a*, 17*a* and 18*a* in a stepwise manner along the rotation axis Y2. Therefore, such a phenomenon that the workpiece may be held by engagement on a shoulder of the next-step tooth generating section protruding beyond the preceding-step one against relative movement from the preceding-step tooth generating section to the next-step one never occurs. Accordingly, while only a slight backward movement of the form roller 12 is necessary for the purpose of smooth movement of the next-step tooth generating section onto the workpiece B in making the next-step tooth generating section ready for working the workpiece B, the form roller 12 can be moved along its rotation axis Y2 as the workpiece B is rotated without stopping its rotation. In this manner, teeth t1 through t4 can be substantially consecutively generated in the workpiece B with first- through fourth-step tooth generating sections 15*a*, 16*a*, 17*a* and 18*a* without stopping the rotation of the workpiece B. As a result, the time taken to generate teeth can be reduced as compared with the case of repeating rotation and stop of the workpiece B, thereby increasing the efficiency of teeth generation.

In addition, if the form roller 12 is of unitary construction as shown in FIG. 7(*c*), such an assembly error as caused in assembling the roller components 15, 16, 17 and 18 into the above-mentioned segmental form roller may not occur. This eliminates the need to pay attention to the alignment of roller components and increases forming accuracy.

In this embodiment, as described above, the drive motor 4 is driven into forward and reverse rotation, thereby increasing forming accuracy on both sides of each of teeth t1 through t4 which serve as mating surfaces of each of fully generated teeth. Additionally, the present invention has its object of finishing the teeth t4 (T) with high accuracy, and is therefore characterized by carrying out the following finishing step.

Figure 9:
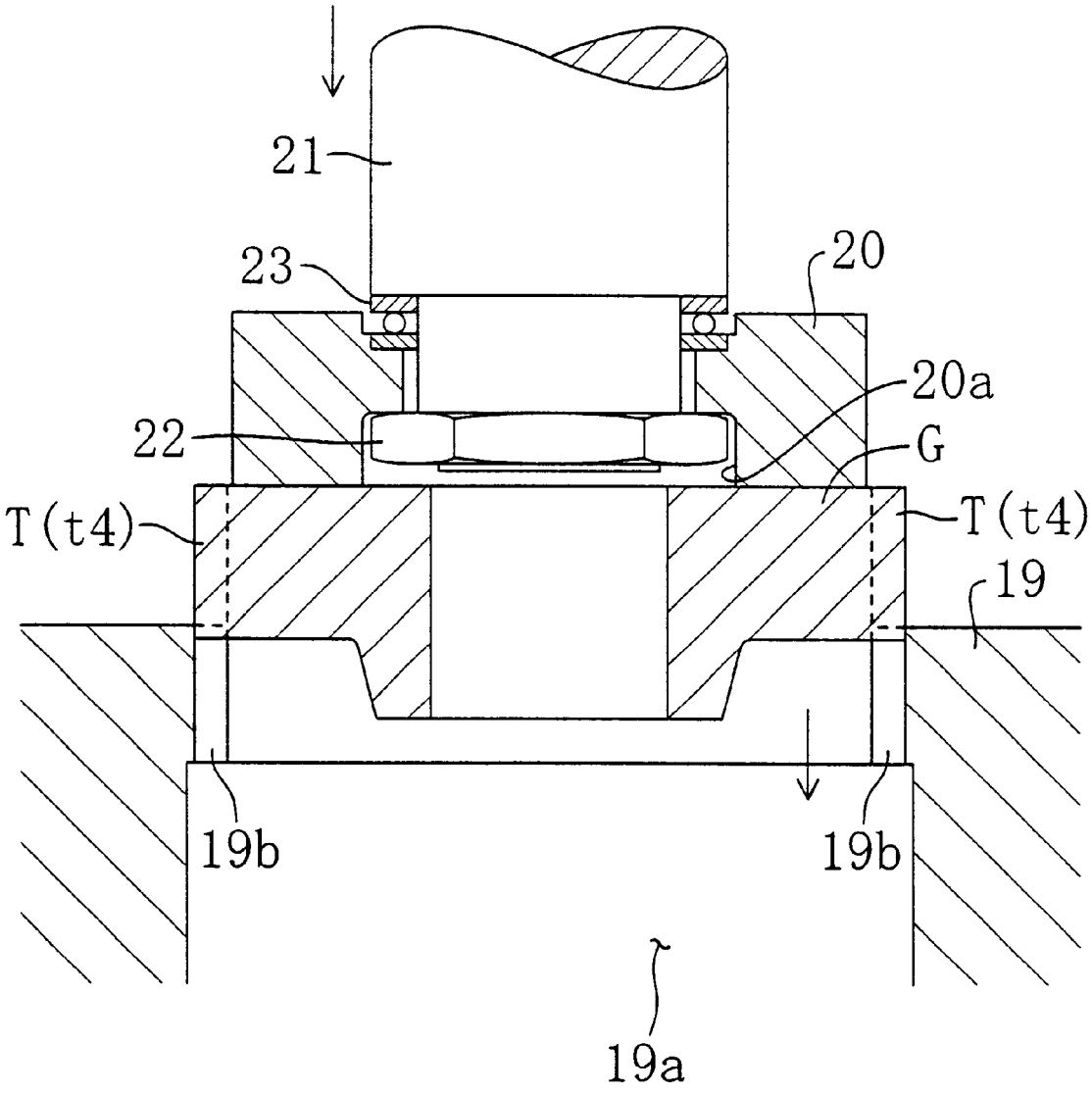
FIG. 9 is a cross-sectional view of a finishing device.

FIG. 9 shows a finishing device used in the finishing step. The finishing device has a die 19 having a setting hole 19*a* formed at the center thereof. A plurality of tooth forms 19*a* corresponding to the teeth T (t4) of the spur gear G are formed throughout the upper end of the inner periphery of the setting hole 19*a*. A punch 20 is placed above the setting hole 19*a* of the die 19 with the lower end of a rod 21 inserted in an insertion hole 20*a* thereof. The punch 20 is supported by a nut 22 threaded onto the lower end of the rod 21 and a bearing 23 located above the nut 22 so as to be held against dropout from the lower end of the rod 21 and freely rotatable around a rotation axis of the rod 21. The freedom of rotation of the punch 20 relative to the rod 21 is for the conformity with items such as a helical gear having obliquely oriented external teeth. In the spur gear G of this example, however, the punch 20 may of necessarily be freely rotatable relative to the rod 21 and may be rigidly fixed to the rod 21.

After the plurality of teeth t1 through t4 of given shape are stepwise generated in the outer periphery of the workpiece B with the external gear tooth generating device as described above, the spur gear G formed with the teeth T (t4) is set at the upper end of the setting hole 19*a* of the die 19, the rod 21 is moved downward with an unshown actuating device to press the spur gear G into the setting hole 19*a* from above with the punch 20, so that the teeth T (t4) are plastically deformed along the tooth forms 19*b* by cold pressing so as to be finished to normal size.

Accordingly, even if the mating surfaces of each of the teeth T (t4) generated by the external gear tooth generating device produce a variation in forming accuracy, such a variation is leveled in the succeeding cold pressing step so that the teeth T (t4) can be finished with high accuracy. In addition, since such leveling is made by cold pressing, the flow line of metal texture can be prevented from being broken thereby ensuring strength.

(Embodiment 2)

FIGS. 10 through 15 show an external gear tooth generating step according to Embodiment 2 of the present invention. This embodiment is constructed in the same manner as Embodiment 1 except for differences in the structure and the associated working process of the form roller 12. Accordingly, description will be made in this embodiment about different points only, the same components will be identified by the same reference characters and the description about them will be omitted. Also, the external gear tooth generating device used for external teeth generation and the finishing device are the same as used in Embodiment 1.

Figure 15B:
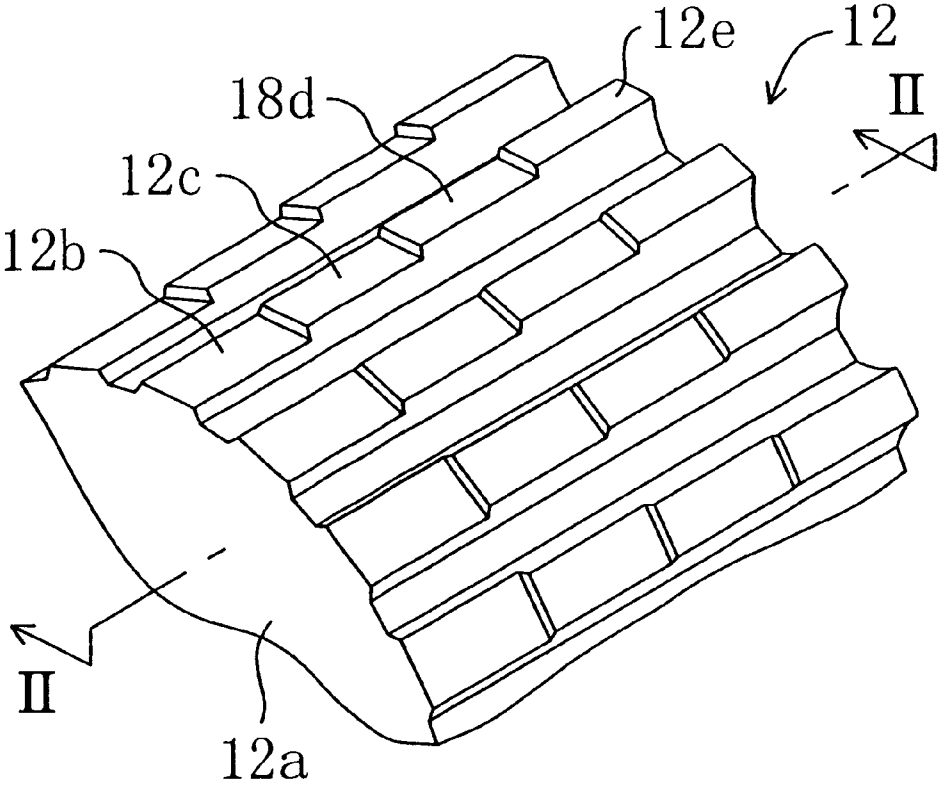
FIG. 15(*a*) is a cross-sectional view taken along the line II—II of FIG. 15(*b*).
Figure 15A:
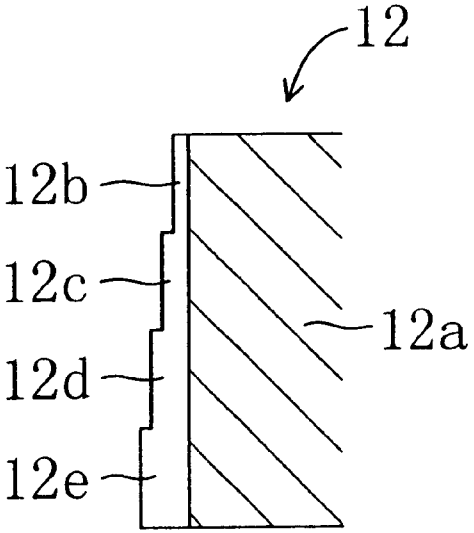

As shown in FIGS. 15(*a*) and 15(*b*), the form roller 12 in this embodiment is of unitary construction like the form roller which is such a modification of Embodiment 1 as shown in FIG. 7(*c*). However, while the form roller in the modification of Embodiment 1 has a construction that the four tooth generating sections from the first-step one 12*b* of smallest tooth height to the fourth-step one 12*e* of greatest tooth height are of equal distances between the rotation axis Y2 and their respective tooth tip faces, i.e., equal outer diameters, and such different distances between the rotation axis Y2 and their respective bottom lands as changed in four steps along the rotation axis Y2, the form roller 12 in this embodiment has a construction that the four tooth generating sections from the first-step one 12*b* of smallest tooth height to the fourth-step one 12*e* of greatest tooth height are of equal distances between the rotation axis Y2 and their respective bottom lands and such different distances between the rotation axis Y2 and their respective tooth tip faces as changed in four steps along the rotation axis Y2.

Accordingly, like the case of using the form roller 12 as in the modification of Embodiment 1, this embodiment has the advantages of being free from such an assembly error of roller components 15, 16, 17 and 18 as caused in a segmental form roller and therefore eliminating the need to pay attention to the alignment of roller components and increasing forming accuracy.

Next, description will be made about respective Steps 1 through 6 in a process of fabricating a spur gear G by generating teeth T in the outer periphery of a workpiece B with the use of the external gear tooth generating device in Embodiment 2 with reference to FIGS. 10 through 14.

Step 1

Figure 10:
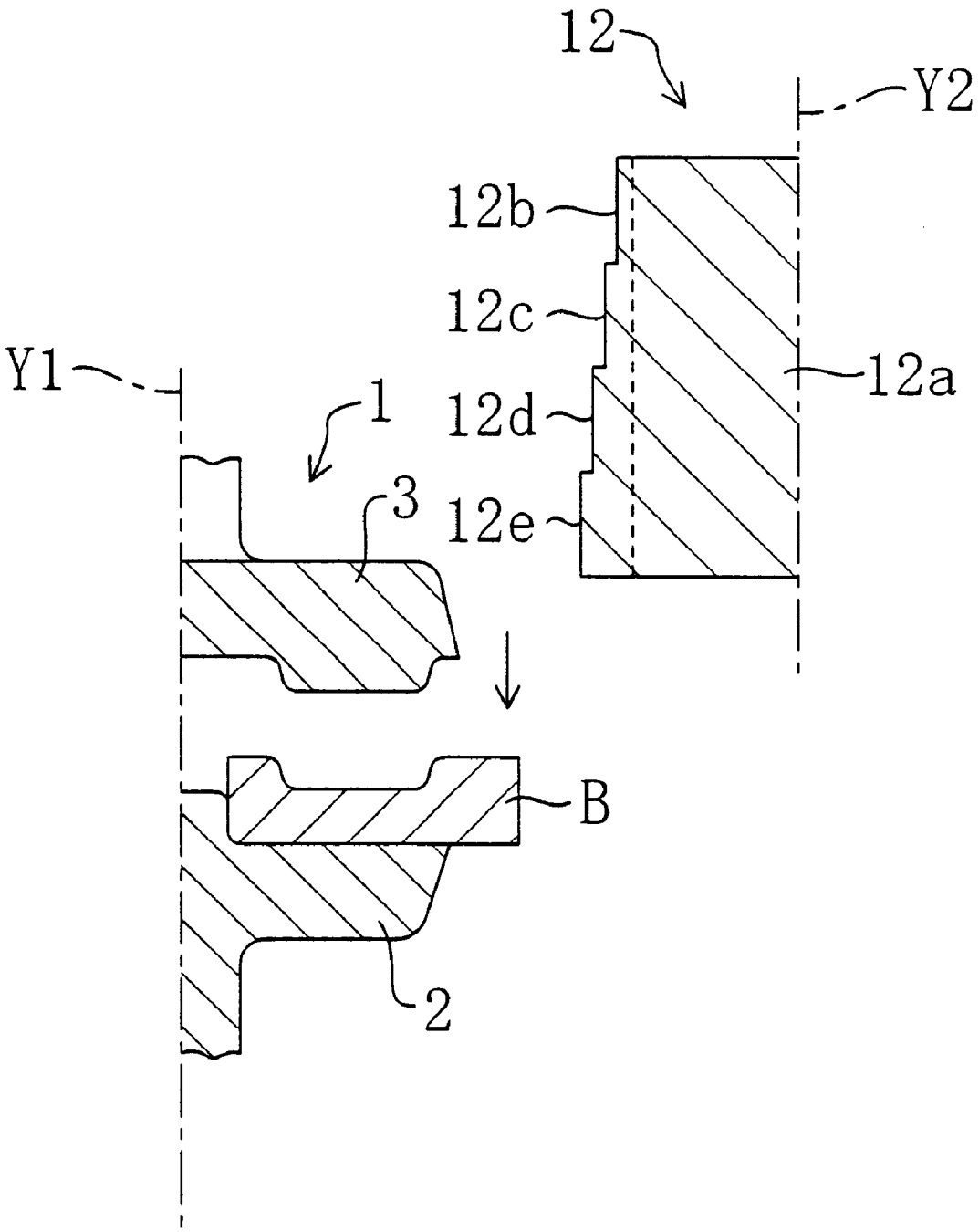
FIG. 10 is a view showing a step of the process in which a workpiece is fixed on a setting stage in Embodiment 2 of the invention.

FIG. 10 illustrates a condition that a spur gear G as a final product with teeth T finally generated has been just removed from the device after the completion of the preceding tooth generating work, in which the holding jig 3 of the setting stage 1 is positioned above and apart from the receiving jig 2 and the form roller 12 has been moved laterally upward from the holding jig 3. In this condition, the piston rod 5*a* of the first fluid-pressure operated cylinder 5 is extended to move the holding jig 3 downward so that the workpiece B is held by the holding jig 3 and set on the setting stage 1.

Step 2

Figure 11A:
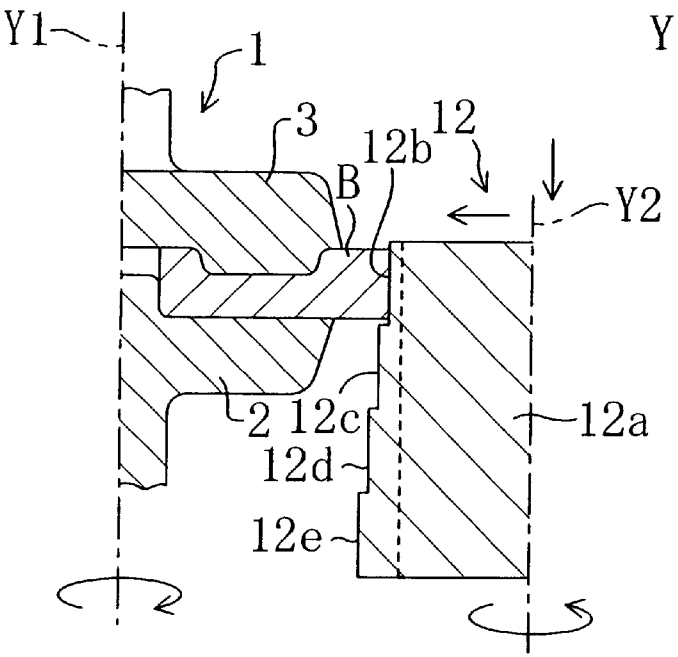
FIG. 11(*a*) is a view showing a step of the process in which a first-step tooth generating section of the form roller is allowed for handling the workpiece in Embodiment 2.
Figure 11B:
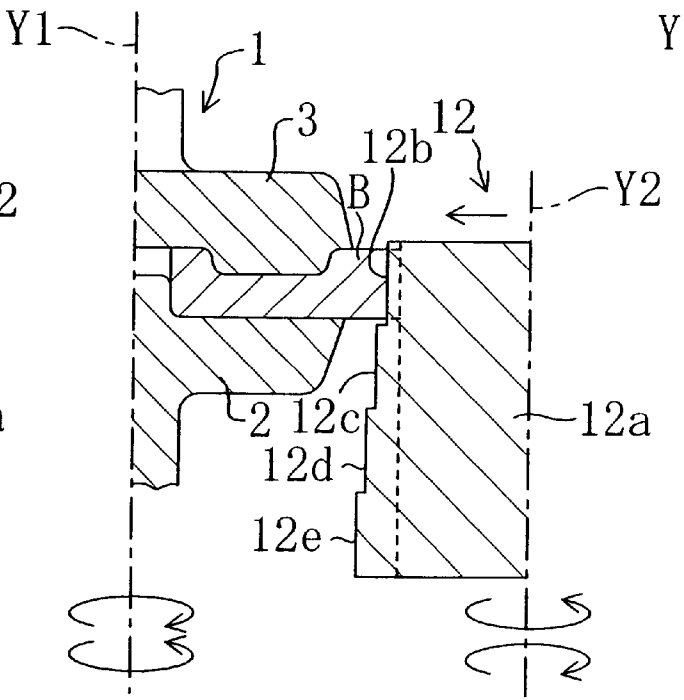
Figure 11C:
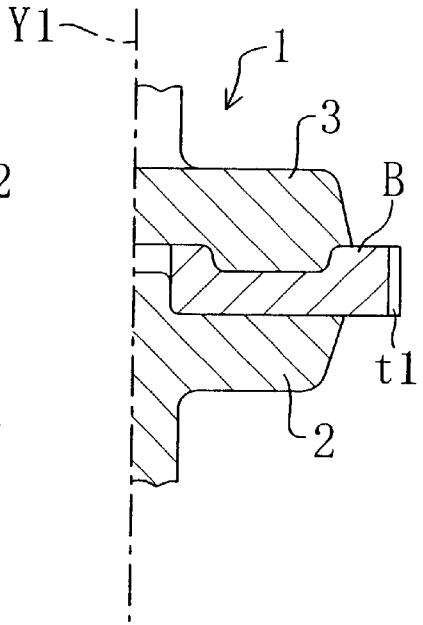

As shown in FIG. 11(*a*), the drive motor 4 is driven into rotation of a single direction to rotate the setting stage 1 and in turn the workpiece B around the rotation axis Y1. In this condition, the piston rod 14*a* of the third fluid-pressure operated cylinder 14 is retracted to move the form roller 12 downward so that the uppermost tooth generating section (hereinafter, referred to as a "first-step tooth generating section") 12*b* of smallest tooth height can be ready for working the outer periphery of the workpiece B. Then, the piston rod 8*a* of the second fluid-pressure operated cylinder 8 is extended to move the form roller 12 closer to the setting stage 1 together with the device base side movable part A3, so that the first-step tooth generating section 12*b* is pressed against the outer periphery of the workpiece B. The rotation force of the workpiece B is thereby transmitted to the form roller 12 so that the form roller 12 generates, with the first-step tooth generating section 12*b*, a plurality of teeth t1 conforming to the profile of the first-step tooth generating section 12*b* in the outer periphery of the workpiece B while rolling therealong in a direction opposite to the workpiece B(see FIGS. 11(*b*) and 11(*c*)). During this period of teeth generation, the drive motor 4 is driven into forward and reverse rotation at specific intervals, thereby increasing forming accuracy on both sides of each of teeth t1 which serve as mating surfaces of each of fully generated teeth.

Step 3

Figures 12A, 12B, 12C:
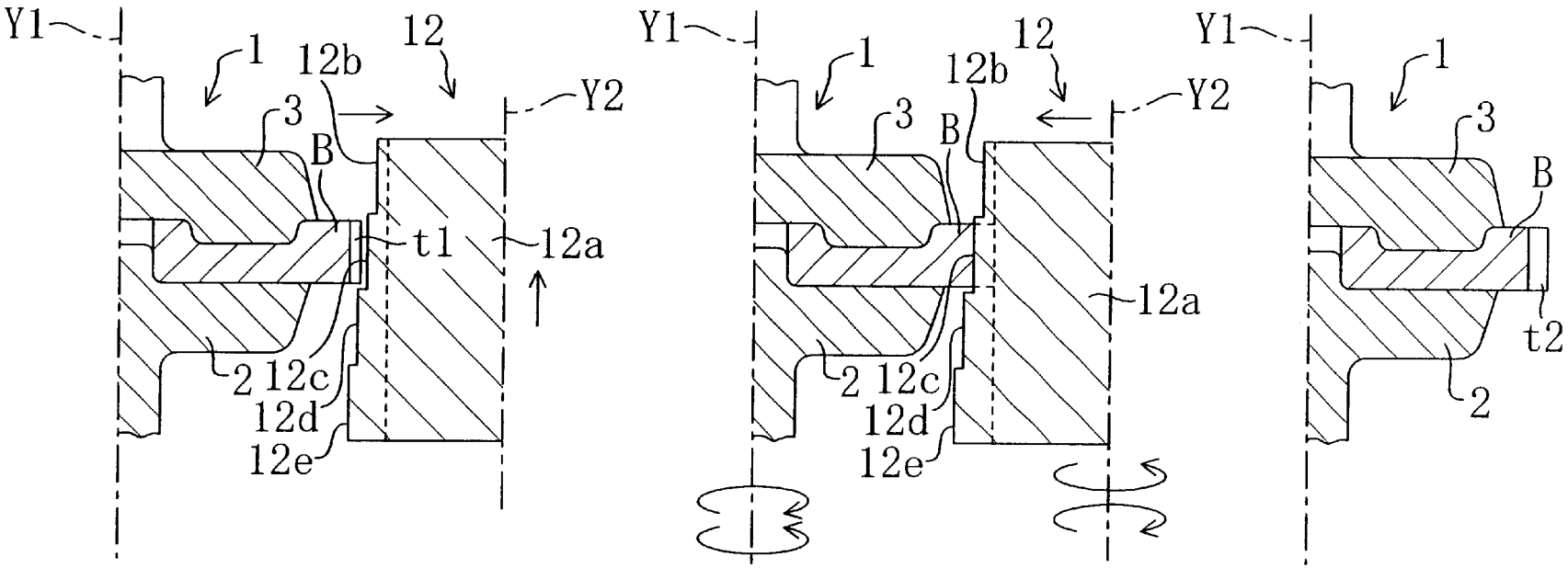
FIG. 12(*a*) is a view showing a step of the process in which a second-step tooth generating section is allowed for handling the workpiece in Embodiment 2.

As shown in FIG. 12(*a*), the drive motor 4 is deactivated to stop the rotations of the workpiece B and the form roller 12. In this condition, the piston rod 8*a* of the second fluid-pressure operated cylinder 8 is retracted to move the form roller 12 backward so that the second-uppermost tooth generating section (hereinafter, referred to as a "second-step tooth generating section") 12*c* of second-smallest tooth height may not interfere with a certain tooth t1 of the workpiece B and can be moved onto the outer periphery of the workpiece B. Next, the piston rod 14*a* of the third fluid-pressure operated cylinder 14 is extended to move the form roller 12 upward so that the second-step tooth generating section 12*c* can be ready for working the outer periphery of the workpiece B. Though in FIG. 12(*a*) the tooth t1 of the workpiece B is shown to be disengaged from the tooth generating section 12*c* of the form roller 12 for sake of visibility, both the parts in actuality are not completely disengaged from each other but engaged. This is also true for the subsequent steps. Thereafter, the drive motor 4 is reactivated to rotate the workpiece B, and the piston rod 8*a* of the second fluid-pressure operated cylinder 8 is then extended to press the second-step tooth generating section 12*c* to the outer periphery (tooth t1) of the workpiece B. As a result, the rotation of the workpiece B is transmitted to the form roller 12 so that a plurality of teeth t2 conforming to the profile of the second-step tooth generating section 12*c* are generated in the outer periphery of the workpiece B with the second-step tooth generating section 12*c* (see FIGS. 12(*b*) and 12(*c*)). Also during this period of teeth generation, the drive motor 4 is driven into forward and reverse rotation at specific intervals, thereby increasing forming accuracy on both sides of each of teeth t2 which serve as mating surfaces of each of fully generated teeth.

Step 4

Figures 13A, 13B, 13C:
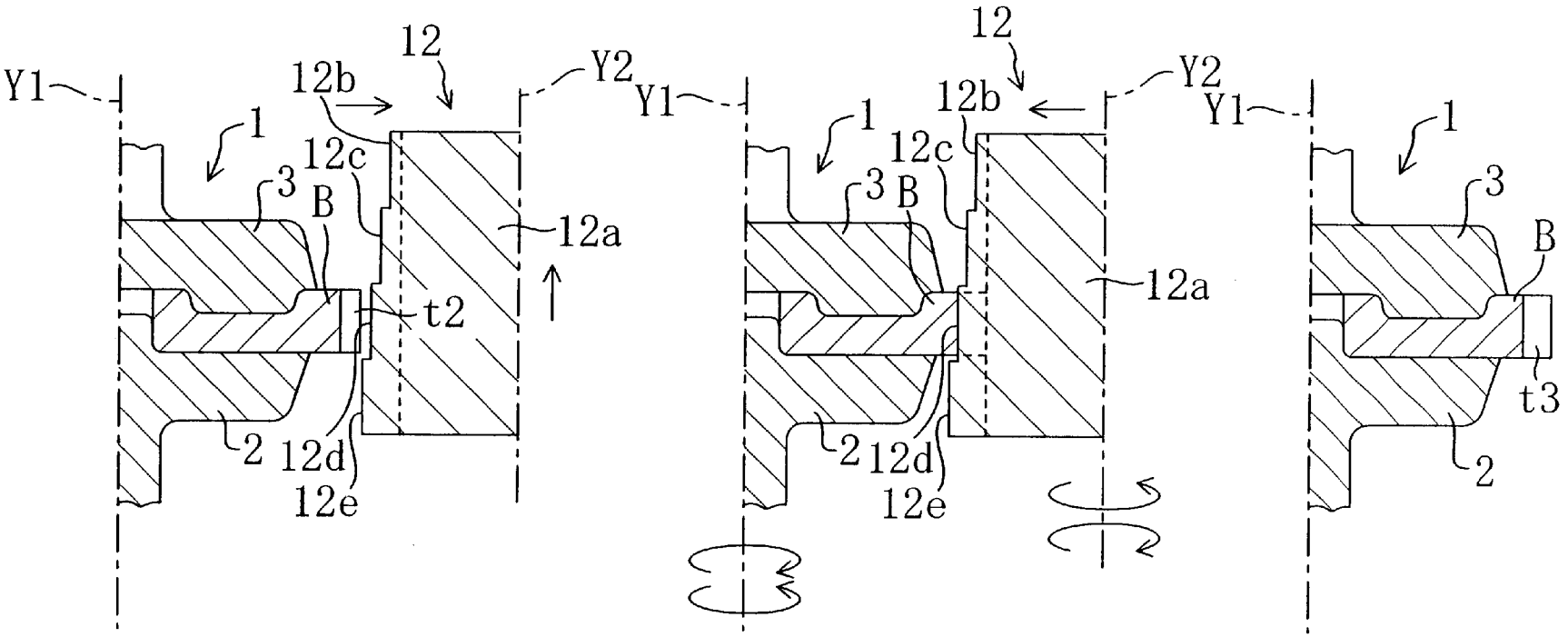
FIG. 13(*a*) is a view showing a step of the process in which a third-step tooth generating section is allowed for handling the workpiece in Embodiment 2.

As shown in FIG. 13(*a*), the drive motor 4 is deactivated to stop the rotations of the workpiece B and the form roller 12. In this condition, the piston rod 8*a* of the second fluid-pressure operated cylinder 8 is retracted to move the form roller 12 backward so that the third-uppermost tooth generating section (hereinafter, referred to as a "third-step tooth generating section") 12*d* of third-smallest tooth height may not interfere with a certain tooth t2 of the workpiece B and can be moved onto the outer periphery of the workpiece B. Next, the piston rod 14*a* of the third fluid-pressure operated cylinder 14 is extended to move the form roller 12 upward so that the third-step tooth generating section 12*d* can be ready for working the outer periphery of the workpiece B. Thereafter, the drive motor 4 is reactivated to rotate the workpiece B, and the piston rod 8*a* of the second fluid-pressure operated cylinder 8 is then extended to press the third-step tooth generating section 12*d* to the outer periphery (tooth t2) of the workpiece B. As a result, the rotation of the workpiece B is transmitted to the form roller 12 so that a plurality of teeth t3 conforming to the profile of the third-step tooth generating section 12*d* are generated in the outer periphery of the workpiece B with the third-step tooth generating section 12*d* (see FIGS. 13(*b*) and 13(*c*)). Also during this period of teeth generation, the drive motor 4 is driven into forward and reverse rotation at specific intervals, thereby increasing forming accuracy on both sides of each of teeth t3 which serve as mating surfaces of each of fully generated teeth.

Step 5

Figures 14A, 14B, 14C:
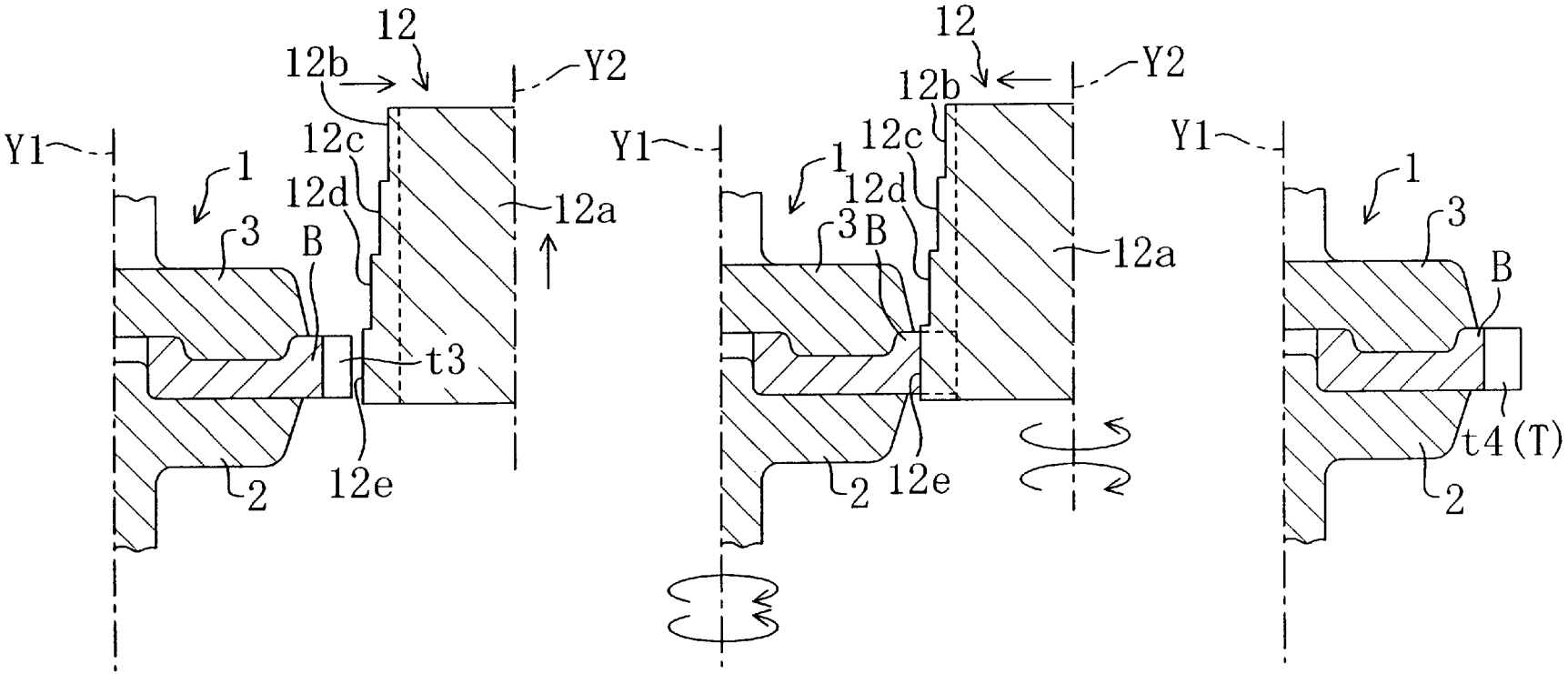
FIG. 14(*a*) is a view showing a step of the process in which a fourth-step tooth generating section is allowed for handling the workpiece in Embodiment 2.

As shown in FIG. 14(*a*), the drive motor 4 is deactivated to stop the rotations of the workpiece B and the form roller 12. In this condition, the piston rod 8*a* of the second fluid-pressure operated cylinder 8 is retracted to move the form roller 12 backward so that the lowermost tooth generating section (hereinafter, referred to as a "fourth-step tooth generating section") 12*e* of greatest tooth height may not interfere with a certain tooth t3 of the workpiece B and can be moved onto the outer periphery of the workpiece B. Next, the piston rod 14*a* of the third fluid-pressure operated cylinder 14 is extended to move the form roller 12 upward so that the fourth-step tooth generating section 12*e* can be ready for working the outer periphery of the workpiece B. Thereafter, the drive motor 4 is reactivated to rotate the workpiece B, and the piston rod 8*a* of the second fluid-pressure operated cylinder 8 is then extended to press the fourth-step tooth generating section 12*e* to the outer periphery (tooth t3) of the workpiece B. As a result, the rotation of the workpiece B is transmitted to the form roller 12 so that a plurality of teeth t4 (teeth T of a spur gear G as a final product) conforming to the profile of the fourth-step tooth generating section 12*e* are generated in the outer periphery of the workpiece B with the fourth-step tooth generating section 12*e* (see FIGS. 14(*b*) and 14(*c*)). Also during this period of teeth generation, the drive motor 4 is driven into forward and reverse rotation at specific intervals, thereby increasing forming accuracy on both sides of each of teeth t4 (T) which serve as mating surfaces of each of fully generated teeth. Particularly in the final stage of this step, the workpiece B is rotated in the same direction as that of the spur gear G as a final product in actual use. Accordingly, like Embodiment 1, mating surfaces of teeth T of the spur gear G with which another spur gear G is mated in actual use can be finished with good smoothness and high accuracy.

Step 6

The drive motor 4 is deactivated to stop the rotation of the spur gear G as a final product. The rotation of the form roller 12 is thereby stopped. In this condition, the piston rod 8*a* of the second fluid-pressure operated cylinder 8 is retracted to move the form roller 12 backward. Then, the piston rod 14*a* of the third fluid-pressure operated cylinder 14 is extended to move the form roller 12 upward for a standby for the next working process. And, the piston rod 5*a* of the first fluid-pressure operated cylinder 5 is retracted to move the holding jig 3 upward and the spur gear G as a final product on the receiving jig 2 is recovered.

Thereafter, like Embodiment 1, the spur gear G, formed by stepwise generating the plurality of teeth t1 through t4 of given shape in the outer periphery of the workpiece B with the external gear tooth generating device as described above, is carried into the finishing device and set at the upper end of the setting hole 19*a* of the die 19, the rod 21 is moved downward with an unshown actuating device to press the spur gear G into the setting hole 19*a* from above with the punch 20, so that the teeth T (t4) are plastically deformed along the tooth forms 19*b* by cold pressing so as to be finished to normal size (see FIG. 9).

Accordingly, also in Embodiment 2, even if the mating surfaces of each of the teeth T (t4) generated by the external gear tooth generating device produce a variation in forming accuracy, such a variation is leveled in the succeeding cold pressing step so that the teeth T (t4) can be finished with high accuracy. In addition, since such leveling is made by cold pressing, the flow line of metal texture can be prevented from being broken thereby ensuring strength.

Embodiments 1 and 2 describe the case where the final product is a spur gear G. However, it goes without saying that a final product to be formed according to this invention may be any other product, such as a helical gear, a sprocket wheel or a spline shaft. Therefore, a workpiece B for use in forming such an item with external gear teeth can be suitably selected from among a variety of metallic materials such as a forging blank, a round bar and a plate according to the purpose of use.

What is claimed is:

1. A method of forming an externally-toothed item, comprising the steps of:

preparing an external gear tooth generating device including a setting stage rotatable around its rotation axis to rotate a workpiece set thereon and a form roller, disposed beside the setting stage, rotatable around its rotation axis parallel with the rotation axis of the setting stage and movable in a direction orthogonal to the rotation axes, the form roller having a plurality of gear-like tooth generating sections arranged along the rotation axis in the outer periphery of the form roller to increase tooth heights of the tooth generating sections in a stepwise manner along the rotation axis;

rotating the workpiece set on the setting stage of the external gear tooth generating device by rotational movement of the setting stage around the rotation axis thereof, moving the form roller in the direction orthogonal to its rotation axis so as to come close to the workpiece to press the tooth generating sections in increasing order of the tooth height against the outer periphery of the workpiece, and stepwise generating a plurality of teeth of given shape in the outer periphery of the workpiece with the tooth generating sections while transmitting the rotation force of the workpiece to the form roller to roll the form roller along the outer periphery of the workpiece, thereby obtaining an externally-toothed item having an outer periphery formed with a plurality of external teeth; and finishing the teeth to size by cold pressing.

2. The method of claim 1, wherein the form roller is constructed so that the tooth generating sections have equal distances between the rotation axis of the form roller and respective tooth tip faces of the tooth generating sections and such different distances between the rotation axis and respective bottom lands of the tooth generating sections as decreased in plural steps along the rotation axis to increase tooth heights of the tooth generating sections in a stepwise manner along the rotation axis.

3. The method of claim 2, wherein the form roller is constructed so that in generating the teeth, the tooth generating sections are consecutively pressed in increasing order of the tooth height against the workpiece without stopping the rotation of the workpiece.

4. The method of claim 1, wherein the form roller is constructed so that the tooth generating sections have equal distances between the rotation axis of the form roller and respective bottom lands of the tooth generating sections and such different distances between the rotation axis and respective tooth tip faces of the tooth generating sections as increased in plural steps along the rotation axis to increase tooth heights of the tooth generating sections in a stepwise manner along the rotation axis.

5. The method of claim 1, wherein the workpiece is a metallic material for generating a spur gear, a helical gear, a sprocket wheel or a splined shaft.

* * * * *